US010267188B2

(12) United States Patent
Weber

(10) Patent No.: US 10,267,188 B2
(45) Date of Patent: Apr. 23, 2019

(54) ROTOR FOR A HYDRAULIC CAMSHAFT ADJUSTER AND MANUFACTURING METHOD FOR A ROTOR FOR A CAMSHAFT ADJUSTER

(71) Applicant: SCHAEFFLER TECHNOLOGIES AG & CO. KG, Herzogenaurach (DE)

(72) Inventor: Juergen Weber, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 157 days.

(21) Appl. No.: 15/506,503

(22) PCT Filed: May 26, 2015

(86) PCT No.: PCT/DE2015/200323

§ 371 (c)(1),
(2) Date: Feb. 24, 2017

(87) PCT Pub. No.: WO2016/029909

PCT Pub. Date: Mar. 3, 2016

(65) Prior Publication Data

US 2017/0268389 A1 Sep. 21, 2017

(30) Foreign Application Priority Data

Aug. 25, 2014 (DE) ..... 10 2014 216 848

(51) Int. Cl.
*F01L 1/344* (2006.01)
*F01L 1/02* (2006.01)

(52) U.S. Cl.
CPC ..... *F01L 1/3442* (2013.01); *F01L 1/024* (2013.01); *F01L 2001/3445* (2013.01);
(Continued)

(58) Field of Classification Search
CPC ..... F01L 1/3442; F01L 2103/00; F01L 2001/3445; F01L 1/024; F01L 2001/34423; F01L 2001/34426
See application file for complete search history.

(56) References Cited

U.S. PATENT DOCUMENTS 7,640,902 B2 1/2010 Knecht et al.
8,490,589 B2 7/2013 Arnold et al.
(Continued)

FOREIGN PATENT DOCUMENTS

DE 10 2008 028 640 12/2009
DE 10 2009 053 600 5/2011
(Continued)

OTHER PUBLICATIONS

International Search Report of PCT/DE2015/200323, dated Nov. 27, 2015, 3 pages.

*Primary Examiner* — Mark A Laurenzi
*Assistant Examiner* — Wesley G Harris
(74) *Attorney, Agent, or Firm* — Davidson, Davidson & Kappel, LLC

(57) ABSTRACT

A rotor for a hydraulic camshaft adjuster. The rotor includes a first rotor element and a second rotor element. At least one of the rotor elements has oil channels separated from each other by radially arranged elevations. Each elevation of the first rotor element has a first joining profile and the second rotor element forms a complementary-shaped second joining profile corresponding to the position of each first joining profile, wherein the first and the second joining profile engage with each other in the assembled rotor. The first joining profile of the first rotor element has a notch and an elevation and the second joining profile of the second rotor element has a notch and an elevation formed in such a way that prior to the joining of the two rotor elements, a height of the elevation of the second joining profile, which engages
(Continued)

in a notch of the first joining profile, is less than a height of the notch of the first joining profile, and a height of the elevation of the first joining profile, which engages in a notch-of the second joining profile, is less than a height of the notch of the second joining profile.

10 Claims, 3 Drawing Sheets

(52) U.S. Cl.
CPC ..... *F01L 2001/34423* (2013.01); *F01L 2001/34426* (2013.01); *F01L 2103/00* (2013.01)

(56) References Cited

U.S. PATENT DOCUMENTS

| | | | | |
|---|---|---|---|---|
| 8,550,046 | B2 | 10/2013 | Terfloth et al. | |
| 8,752,517 | B2 | 6/2014 | Boese et al. | |
| 8,931,448 | B2 * | 1/2015 | Schelter | F01L 1/46 123/90.15 |
| 9,255,499 | B2 | 2/2016 | Howarth et al. | |
| 9,284,862 | B2 | 3/2016 | Frey | |
| 9,970,334 | B2 * | 5/2018 | Brenner | F01L 1/3442 |
| 2008/0254900 | A1 | 10/2008 | Urckfitz et al. | |
| 2012/0132160 | A1 * | 5/2012 | Malen | B22F 5/008 123/90.15 |
| 2013/0199479 | A1 * | 8/2013 | Ottersbach | F01L 1/3442 123/90.17 |
| 2017/0037746 | A1 * | 2/2017 | Weber | F01L 1/3442 |

FOREIGN PATENT DOCUMENTS

| | | |
|---|---|---|
| DE | 10 2011 117 856 | 5/2013 |
| DE | 102012200756 | 7/2013 |
| EP | 1 731 722 | 12/2006 |
| EP | 2 300 693 | 3/2011 |
| GB | 1174624 | 12/1969 |
| WO | WO2009/152987 | 12/2009 |
| WO | WO2011098331 | 8/2011 |
| WO | WO2013164272 | 11/2013 |

* cited by examiner

ROTOR FOR A HYDRAULIC CAMSHAFT ADJUSTER AND MANUFACTURING METHOD FOR A ROTOR FOR A CAMSHAFT ADJUSTER

The present invention relates to a rotor for a hydraulic camshaft adjuster. The rotor is rotatably movable around an axis and includes a first rotor element and a second rotor element. At least one of the rotor elements has a plurality of oil channels, which are separated from each other by radially arranged elevations. Each elevation of the first rotor element forms a first joining profile, and the second rotor element forms a complementarily shaped second joining profile corresponding to the position of each first joining profile. The first and second joining profiles engage with each other in the assembled rotor made up of the first and second rotor elements.

The present invention furthermore relates to a manufacturing method for a rotor for a hydraulic camshaft adjuster.

BACKGROUND

It is generally known that camshaft adjusters permit optimum valve timings over a broad range of loads and rotational speeds. Significant reductions in emissions and fuel consumption are thus implemented. In addition, driving enjoyment is significantly increased by optimizing the torque and power. According to the prior art, a distinction is made between electrical camshaft adjusters and the hydraulic camshaft adjusters mentioned at the outset.

In the area of hydraulic camshaft adjusters, rotors are known which include a first rotor element and a second rotor element. This is disclosed, for example, in the German unexamined patent application DE 10 2009 053 600 A1. In this case, the two rotor elements are connected or sintered with the aid of pins. Another specific embodiment for connecting two rotor elements of a rotor is described in the German unexamined patent application DE 10 2008 028 640 A1. Two rotor elements are provided here in such a way that they may be joined together on the basis of their particular "own" geometry. In addition, the European patent specification EP 2 300 693 B1 describes two identical, joined rotor elements, which have a form fit and a press fit to form the oil channels. A design of the rotor as an assembly system is disclosed in the European patent specification EP 1 731 722 B1, the rotor core and the cover forming the oil channels. In the aforementioned publications, the oil penetrating between the two rotor elements generates internal and external leaks between two oil channels in each case. These leaks cause a pressure drop in the assembled rotor and thus a reduction in the adjusting speed of the hydraulic camshaft adjuster.

Another hydraulic camshaft adjuster, which includes a first and a second rotor element, is disclosed in the German unexamined patent application DE 10 2011 117 856 A1. The two rotor elements here seal oil channels with the aid of sintered bevels. The problem with this approach, however, is that a rebound of the two rotor elements occurs in the longitudinal interference fit during the operation of the camshaft adjuster.

SUMMARY OF THE INVENTION

It is an object of the present invention to provide a rotor for a hydraulic camshaft adjuster, in which two rotor elements of the rotor are cost-effectively connected, and, in addition, a secure holding together of the rotor elements is ensured even during operation.

Another object of the present invention is to provide an economical manufacturing method for a rotor for a hydraulic camshaft adjuster, in which two rotor elements of the rotor are cost-effectively and accurately connected, and, in addition, a secure holding together of the rotor elements is ensured even during operation.

The rotor according to the present invention for a hydraulic camshaft adjuster is rotatably movable around an axis and includes a first rotor element and a second rotor element. At least one of the two rotor elements has a plurality of oil channels, which are separated from each other by radially arranged elevations. Each elevation of the first rotor element forms a first joining profile, and the second rotor element forms a complementarily shaped second joining profile corresponding to the position of each first joining profile. The two joining profiles engage with each other in the assembled rotor made up of the first and second rotor elements.

According to the present invention, the first joining profile of the first rotor element has a notch and an elevation, and the second joining profile of the second rotor element has a notch and an elevation, formed in such a way that, prior to the joining of the two rotor elements, a height of the elevation of the second joining profile, which engages with a notch of the first joining profile, is less than a height of the notch of the first joining profile, and a height of the elevation of the first joining profile, which engages with a notch of the second joining profile, is less than a height of the notch of the second joining profile. The joining profiles thus approximately form an S shape and are formed as mirror images of each other. These joining profiles of the first and second rotor elements are preferably already manufactured during the manufacturing of the two rotor elements in the sintering compression mold due to a material displacement at the particular contact sides of the rotor elements.

The present invention thus provides that, prior to the joining of the two rotor elements, a clearance is formed between the first and second rotor elements with the aid of the height of the elevation of the first and second joining profiles, the height being less than the height of the notch of the first and second joining profiles. This particular clearance between an elevation of the first and second joining profiles and a notch of the first and second joining profiles, formed during the joining operation, has the advantage that the two rotor elements are joined together to form an accurate fit, and only reduced forces occur, which would drive the first and second rotor elements apart. The problem of a rebound, which occurs in the prior art, is thus eliminated in the design according to the present invention.

In one first preferred specific embodiment of the present invention, each notch of the first and second joining profiles is provided with a rounded area. Each elevation of the first and second joining profiles is then also provided with a flattened area. The designs of the notch or flattened area illustrated herein are not to be understood as a limitation of the present invention. The only condition is that a clearance is formed between the elevation and the flattened area.

Other specific embodiments of the rotor according to the present invention provide for special dimensions. Thus, a basic width of the elevation and a basic width of the notch of the first and second joining profiles are preferably 0.5 mm to 10.0 mm. Moreover, in the rotor according to the present invention, the height of the elevation and the height of the notch of the first and second joining profiles are preferably 0.1 mm to 5.0 mm. It is furthermore preferably provided that the height of the elevation of the first and second joining profiles is less than the height of the notch of the first and second joining profiles by 0.1 mm to 1.0 mm.

In another specific embodiment of the rotor according to the present invention, the first and second joining profiles are designed in an elastically resilient manner in such a way that the elevations in the notches of the first and second joining profiles each form an overlap on each lateral edge of the first and second joining profiles in the assembled rotor, and each clearance in the assembled rotor is at least partially filled with the material from the first and second joining profiles. The overlap on each lateral edge is thus preferably 0.005 mm to 1.0 mm. This means that the two rotor elements have a slight negative allowance for forming an overlap on each of the lateral edges of the first and second joining profiles, so that the edges engage with each other in an elastically resilient manner during the joining of the two rotor elements and thereby create an axial longitudinal interference fit. In particular, the clearances described above also accommodate material deformations of the first and second joining profiles of the two rotor elements from the longitudinal interference fit during operation, to avoid the plastification of the material in the longitudinal interference fit and the setting of the joint connection.

Another specific embodiment of the present invention furthermore provides that the elevations in the notches of the first and second joining profiles each have two lateral edges which enclose an acute angle with respect to each other. This acute angle is preferably from 0° to 35°, since this inclination is suitable for better demolding with the aid of the compression mold.

Another preferred specific embodiment of the rotor according to the present invention provides that the plurality of oil channels of the first rotor element and the second rotor element, which run in a radial direction, are each separated by radially arranged elevations, and each elevation of the first rotor element has formed the first joining profile, and each elevation of the second rotor element has formed the second and complementarily shaped joining profile.

Another specific embodiment preferably provides that the first joining profile is provided on each elevation of the first rotor element, and the second joining provide is provided on each elevation of the second rotor element in such a way that the first and second joining profiles each run from an inner area to an outer area of the first and second rotor elements.

In another specific embodiment of the present invention, the first and second rotor elements are provided with multiple vanes, each of which includes the elevation. In this case as well, the two joining profiles thus run from an inner area to an outer area on the elevations of the first rotor element and the second rotor element.

The manufacturing method according to the present invention for a rotor for a hydraulic camshaft adjuster is characterized by the following step: A first rotor element and a second rotor element are joined by their particular contact sides in such a way that multiple first joining profiles of the first rotor element and corresponding second joining profiles of the second rotor element engage with each other in such a way that a clearance is formed between each elevation of the multiple second joining profiles and each notch of the first joining profiles as well as between each elevation of the multiple first joining profiles and each notch of the second joining profiles prior to the joining of the two rotor elements.

Due to the clearances formed by the first and second joining profiles, the problem generally known and occurring in the prior art of a driving apart of two rotor elements of an assembled rotor is eliminated with the aid of the present invention. The rotor elements, in particular the joining profiles, thus no longer have a rebound effect. In addition, the engagement of the two joining profiles also makes it possible to secure the two rotor elements against rotating relative to each other during operation, due to the present invention.

BRIEF DESCRIPTION OF THE DRAWINGS

Exemplary embodiments of the present invention and their advantages are explained in greater detail below on the basis of the attached figures. The proportions in the figures do not always correspond to the real proportions, since some shapes have been simplified and other shapes have been enlarged in relation to other elements for the purpose of better clarification.

DETAILED DESCRIPTION

Figure 1:
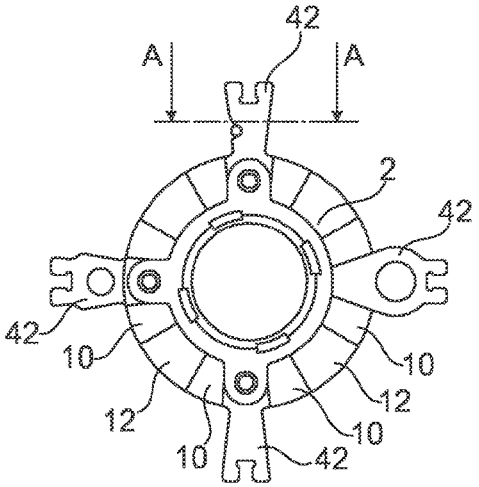
Fig. 1 Prior Art
FIG. 1 shows a top view of a rotor for a hydraulic camshaft adjuster, which is known from the prior art.

Identical reference numerals are used for the same elements or elements having the same function. Furthermore, for the sake of clarity, only reference numerals which are necessary for describing the particular figure are shown in the individual figures. The illustrated specific embodiments represent only examples of how the rotor according to the present invention for a hydraulic camshaft adjuster and the manufacturing method according to the present invention for a rotor for a hydraulic camshaft adjuster may be designed, and they thus do not represent a final limitation of the present invention. The designations of the first rotor element and the second rotor element may be used interchangeably.

Figure 2:
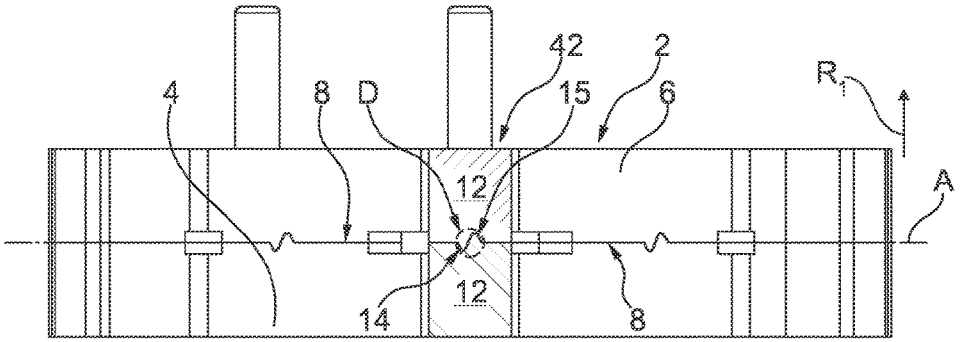
Fig. 2 Prior Art
FIG. 2 shows a side view of the rotor from FIG. 1, a vane being represented in the sectional view along line A-A from FIG. 1.

FIG. 1 shows a top view and FIG. 2 a side view of rotor 2, a vane 42 being represented in the sectional view along line A-A from FIG. 1. Rotor 2 is known from the prior art to be suitable for a hydraulic camshaft adjuster (not illustrated). Rotor 2 is rotatably movable around an axis A and includes a first rotor element 4 and a second rotor element 6. At least one of rotor elements 4, 6 also has a plurality of oil channels 10, which are separated from each other by radially arranged elevations 12.

Figure 3:
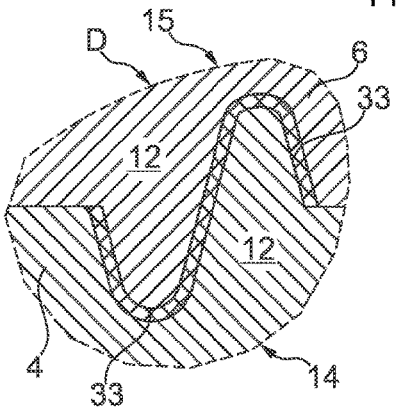
Fig. 3 Prior Art
FIG. 3 shows an enlarged detail of the area marked D in FIG. 2.
Figure 4:
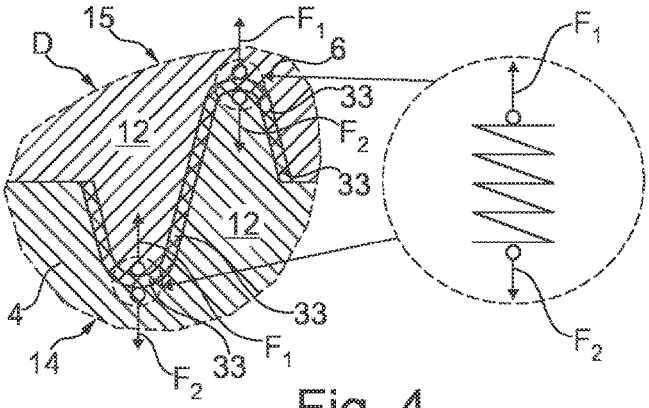
Fig. 4 Prior Art
FIG. 4 also shows an enlarged detail of the area marked D in FIG. 2.

Each elevation 12 or each contact side 8 of first and second rotor elements 4, 6 includes multiple joining profiles 14, 15, as illustrated in FIGS. 3 and 4 in an enlarged detail of the area marked D in FIG. 2. Each elevation 12 of first rotor element 4 forms a first joining profile 14, and second rotor element 6 forms a complementarily shaped second joining profile 15 corresponding to the position of each first joining profile 14. First and second joining profiles 14, 15 engage with each other in assembled rotor 2 made up of the first and second rotor elements 4, 6. However, it is problematic in this case that an overlap 33 is shared by first and second joining profiles 14, 15, so that both of elastically resilient joining profiles 14, 15 have a rebound effect. This is schematically illustrated, in particular, on the basis of the area marked Z in FIG. 4. Oppositely oriented forces F1, F2, which induce an unnecessary driving apart of first and second rotor elements 4, 6 during operation, occur at first and second joining profiles 14, 15. Oppositely oriented forces F1, F2 thus have a rebound effect.

Figure 5:
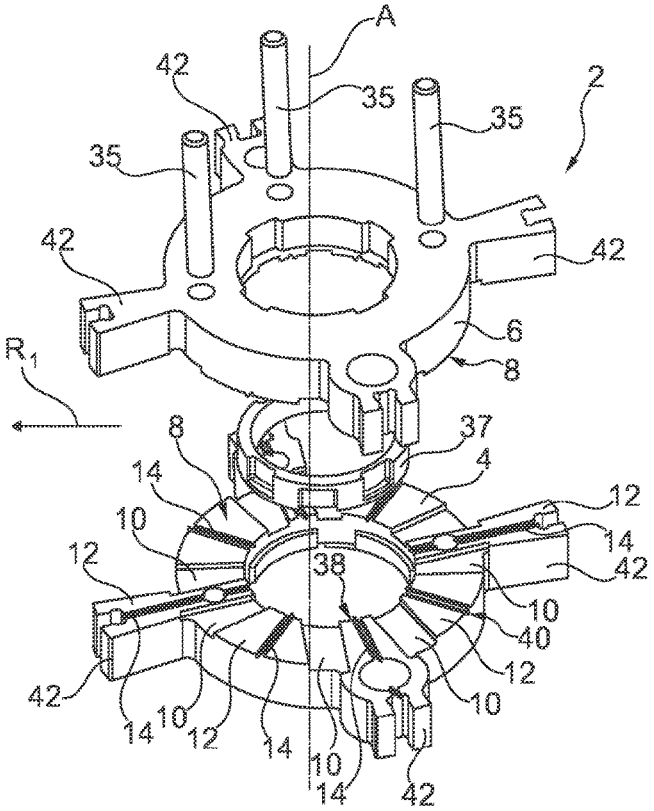
FIG. 5 shows an exploded view of the rotor according to the present invention for a hydraulic camshaft adjuster, including a first and a second rotor element.
Figure 10:
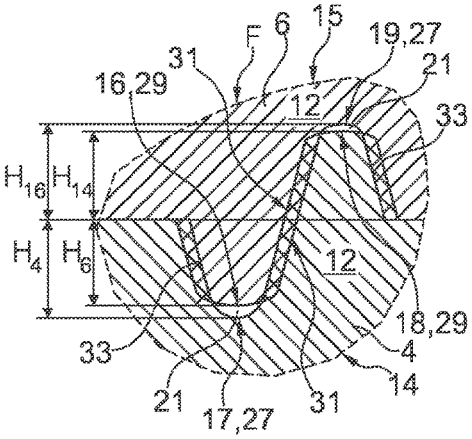
FIG. 10 shows an enlarged detail of the area marked F in FIG. 9.
Figure 11:
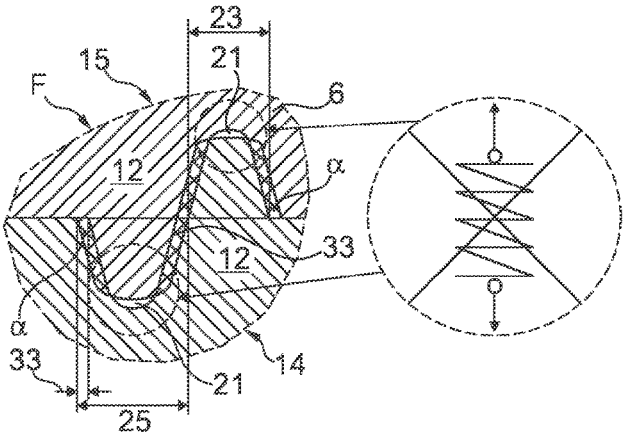
FIG. 11 also shows an enlarged detail of the area marked F in FIG. 9.

FIG. 5 shows an exploded view of rotor 2 according to the present invention for a hydraulic camshaft adjuster, including a first and a second rotor element 4, 6. The structure of oil channels 10 and elevations 12 of first and second rotor elements 4, 6 is similar to the preceding description of FIGS. 1 through 4. Likewise, first joining profiles 14 in this case also engage with complementarily shaped second joining profiles 15 (see FIGS. 10 and 11) in assembled rotor 2 according to the present invention, as illustrated in an enlarged perspective view in FIG. 6 and in an enlarged detail of the area in FIG. 7 marked E in FIG. 6. For example, as also illustrated in FIG. 5, first and second rotor elements 4, 6 are connected to each other via pins 35 and/or with the aid of an oil distribution and centering sleeve 37. Pins 35 also represent an anti-rotation mechanism. However, it is also self-evident that the two rotor elements 4, 6 are also connectable to each other with the aid of other known connecting systems.

Figure 6:
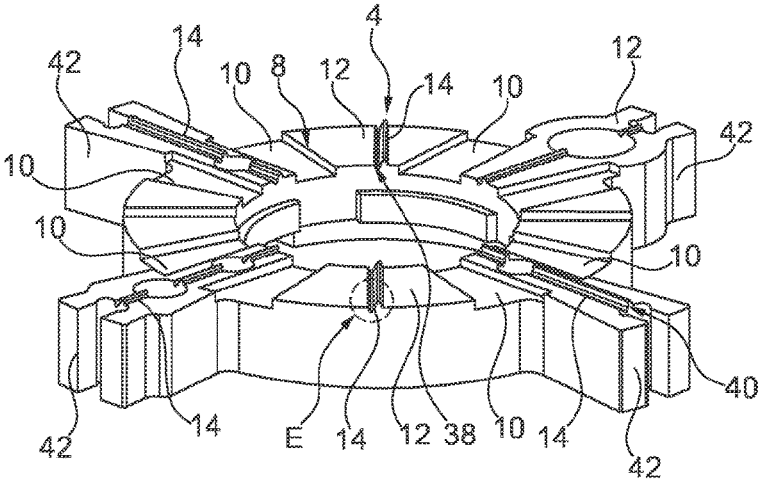
FIG. 6 shows an enlarged perspective view of a contact side of the first rotor element from FIG. 5.
Figure 7:
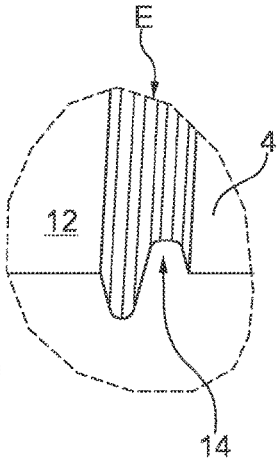
FIG. 7 shows an enlarged detail of the area marked E in FIG. 6.

As is also apparent from the specific embodiment in FIGS. 5 and 6, the plurality of oil channels 10 of first rotor element 4 and second rotor element 6 running in a radial direction R1 are each separated from each other by radially arranged elevations 12. Likewise, oil channels 10 may run radially and axially in other specific embodiments, even if this is not illustrated herein. Each elevation 12 of first rotor element 4 forms first joining profile 14, and each elevation 12 of second rotor element 6 forms second and complementarily shaped joining profile 15. In particular, first joining profile 14 is provided on each elevation 12 of first rotor element 4, and second joining profile 15 is provided on each elevation 12 of second rotor element 6 in such a way that first and second joining profiles 14, 15 each run from an inner area 38 to an outer area 40 of first and second rotor elements 4, 6. Likewise, first and second rotor elements 4, 6 include multiple vanes 42, each of which includes elevation 12. In this case as well, the two joining profiles 14, 15 thus run from inner area 38 to outer area 40 on elevations 12 of first rotor element 4 and second rotor element 6.

Figure 8:
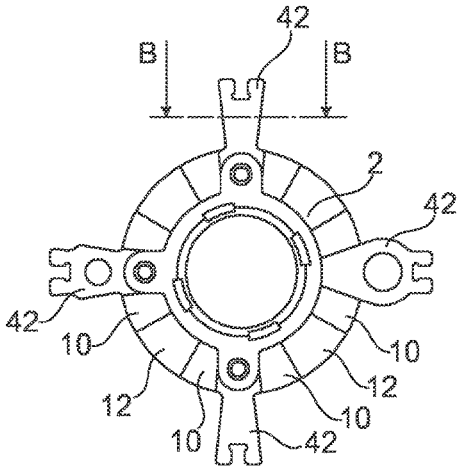
FIG. 8 shows a top view of the rotor according to the present invention for a hydraulic camshaft adjuster.
Figure 9:
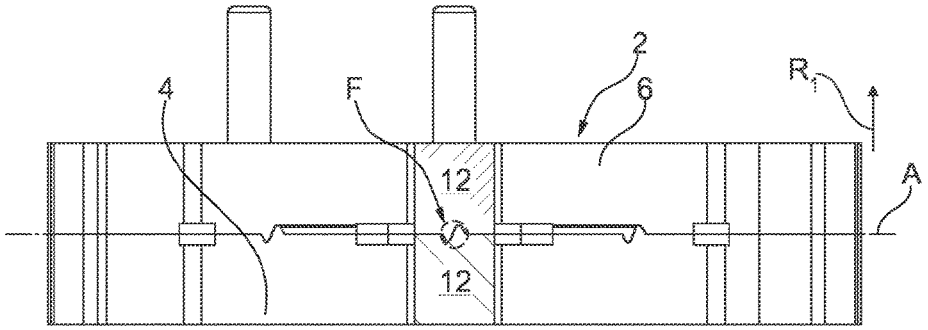
FIG. 9 shows a side view of the rotor according to the present invention from FIG. 8, a vane being represented in the sectional view along line B-B from FIG. 8.

FIG. 8 shows a top view and FIG. 9 a side view of rotor 2 according to the present invention, a vane 42 being represented in the sectional view of rotor 2 according to the present invention described above, along line B-B from FIG. 8. The essential advantages of the present invention over the prior art are properly illustrated only in the enlarged details of the area in FIGS. 10 and 11 marked F in FIG. 9, namely that first joining profile 14 of first rotor element 4 has a notch 17 and an elevation 18, and second joining profile 15 of second rotor element 6 has a notch 19 and an elevation 16 in such a way that a height $H_6$ of elevation 16 of second joining profile 15, which engages with a notch 17 of first joining profile 14, is less than a height $H_4$ of notch 17 of first joining profile 14, and a height $H_{14}$ of elevation 18 of first joining profile 14, which engages with a notch 19 of second joining profile 15, is less than a height $H_{16}$ of notch 19 of second joining profile 15.

With the aid of heights $H_6$, $H_{14}$ of elevations 16, 18 of first and second joining profiles 14, 15, which are less than heights $H_4$, $H_{16}$ of notches 17, 19 of first and second joining profiles 14, 15, a clearance 21 is thus formed between particular elevations 16, 18 and particular notches 17, 19 of first and second rotor elements 4, 6. This clearance 21 formed thereby thus prevents the two rotor elements 4, 6 from being driven apart during operation. As a result, no forces occur which would drive first and second rotor elements 4, 6 apart. As is also illustrated herein, each notch 17, 19 of first and second joining profiles 14, 15 advantageously provides a rounded area 27, each elevation 16, 18 of first and second joining profiles 14, 15 then preferably providing a flattened area 29, so that clearance 21 is formed thereby. Thus, a basic width 23 of elevations 16, 18 and a basic width 25 of notches 17, 19 of first and second joining profiles 14, 15 are preferably 0.5 mm to 2.0 mm.

It is preferably also provided in the present invention that first and second joining profiles 14, 15 are designed in an elastically resilient manner in such a way that elevations 16, 18 in notches 17, 19 of first and second joining profiles 14, 15 each form an overlap 33 on each lateral edge 31 of first and second joining profiles 14, 15 in assembled rotor 2, and each clearance 21 in an assembled rotor 2 is at least partially filled with the material from first and second joining profiles 14, 15. Overlap 33 on each lateral edge 31 is thus preferably 0.005 mm to 1.0 mm. This means that the two rotor elements 4, 6 have a slight negative allowance (not illustrated) for forming an overlap 33 on each of lateral edges 31 of first and second joining profiles 14, 15, so that edges 31 engage with each other in an elastically resilient manner during the joining of the two rotor elements 4, 6 and thereby create an axial longitudinal interference fit. In particular, clearances 21 described above accommodate material deformations of first and second joining profiles 14, 15 of the two rotor elements 4, 6 from the longitudinal interference fit during operation.

As is also illustrated herein, elevations 16, 18 in notches 17, 19 of first and second joining profiles 14, 15 each have two lateral edges 31, which enclose an acute angle $\alpha$ with respect to each other. This acute angle $\alpha$ is preferably from 0° to 35°, since this inclination is suitable for better demolding with the aid of the compression mold.

LIST OF REFERENCE NUMERALS

2 rotor
4 first rotor element
6 second rotor element
8 contact side
10 oil channel
12 elevation
14 first joining profile
15 second joining profile
16 elevation of the second joining profile
17 notch of the first joining profile
18 elevation of the first joining profile
19 notch of the second joining profile
21 clearance
23 basic width of the elevation
25 basic width of the notch
27 rounded area
29 flattened area

31 edge
33 overlap
35 pin
37 oil distribution and centering sleeve
38 inner area
40 outer area
42 vane
A axis
F1 force
F2 force
$H_4$ height of the notch of the first joining profile
$H_6$ height of the elevation of the second joining profile
$H_{14}$ height of the elevation of the first joining profile
$H_{16}$ height of the notch of the second joining profile
R1 radial direction
$\alpha$ angle

What is claimed is:

1. A rotor for a hydraulic camshaft adjuster, the rotor being rotatably movable around an axis and comprising:

a first rotor element; and a second rotor element, at least one of the first and second rotor elements having a plurality of oil channels separated from each other by radially arranged elevations, the first rotor element having a first joining profile having a first notch and a first elevation, and the second rotor element having formed a complementarily shaped second joining profile corresponding to the position of each first joining profile, the second joining profile having a second notch and a second elevation, the first and the second joining profiles engaging with each other when joined when the rotor is assembled, and prior to the joining of the first and second rotor elements, a second elevation height of the second elevation, which engages with the first notch, is less than a first notch height of the first notch, and a first elevation height of the first elevation, which engages with the second notch, is less than a second notch height of the second notch.

2. The rotor as recited in claim 1 wherein a first clearance is formed between the first elevation and the second notch and a second clearance is formed between the second elevation and the first notch prior to the joining of the first and second rotor elements.

3. The rotor as recited in claim 2 wherein the first and second joining profiles are designed in an elastically resilient manner in such a way that the first and second elevations in the respective second and first notches each form an overlap on each lateral edge of the first and second joining profiles in the rotor when assembled, and each of the first clearance and the second clearance in the assembled rotor is at least partially filled with the material from the first and second joining profiles.

4. The rotor as recited in claim 3 wherein the first and second elevations in the second and first notches each have two lateral edges enclosing an acute angle with respect to each other.

5. The rotor as recited in claim 1 wherein each of the first and second notches has a rounded area, and each of the first and second elevations has a flattened area.

6. The rotor as recited in claim 1 wherein a base width of the first and second elevations and of the first and second notch of the first and second joining profiles is 0.5 mm to 10.0 mm.

7. The rotor as recited in claim 1 the first and second elevation heights and the first and second notch height are 0.5 mm to 5.0 mm.

8. The rotor as recited in claim 1 wherein the plurality of the oil channels of the first rotor element and the second rotor element run in a radial direction, and are each separated from each other by radially arranged elevations, and each elevation of the first rotor element has formed the first joining profile, and each elevation of the second rotor element has formed the second and complementarily shaped joining profile.

9. The rotor as recited in claim 1 wherein the first joining profile is provided on each first elevation, and the second joining profile is provided on each second elevation of the second rotor element in such a way that the first and second joining profiles each run from an inner area to an outer area of the first and second rotor elements.

10. A manufacturing method for the rotor as recited in claim 1, the method comprising:

joining the first rotor element and the second rotor element by their particular contact side in such a way that multiple first joining profiles of the first rotor element and corresponding multiple second joining profiles of the second rotor element engage with each other in such a way that a clearance is formed between each second elevation of the multiple second joining profiles and each first notch of the multiple first joining profiles as well as between each first elevation of the multiple first joining profiles and each second notch of the multiple second joining profiles prior to the assembly of the first and second rotor elements.

* * * * *